US009518795B1

(12) United States Patent
Dix et al.

(10) Patent No.: US 9,518,795 B1
(45) Date of Patent: Dec. 13, 2016

(54) MECHANISM TO ADJUST AND RESTRAIN GUN TRAVERSE ON A TRIPOD MOUNT

(71) Applicants: Stephen M. Dix, Fredericksburg, VA (US); Tracy V. White, Dunnsville, VA (US); Arturo M. Lopez, White Plains, MD (US)

(72) Inventors: Stephen M. Dix, Fredericksburg, VA (US); Tracy V. White, Dunnsville, VA (US); Arturo M. Lopez, White Plains, MD (US)

(73) Assignee: The United States Of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 14/752,707

(22) Filed: Jun. 26, 2015

(51) Int. Cl.
*F41A 23/00* (2006.01)
*F41A 27/12* (2006.01)

(52) U.S. Cl.
CPC ..... *F41A 27/12* (2013.01)

(58) Field of Classification Search
CPC ..... F41A 27/12
USPC ..... 89/37.01
See application file for complete search history.

(56) References Cited

U.S. PATENT DOCUMENTS 1,335,403 A * 3/1920 Stanley ..... F41A 23/12 89/40.06
1,560,564 A * 11/1925 Gorton ..... F41A 23/12 89/40.06
1,671,281 A * 5/1928 Gorton ..... F16M 11/32 89/40.06
1,722,629 A * 7/1929 Hatcher ..... F41A 23/02 89/40.06
2,415,024 A * 1/1947 Allen ..... F41A 23/36 280/103
2,429,713 A * 10/1947 Frease ..... F41A 27/04 74/47
4,066,000 A * 1/1978 Rostocil ..... F41A 9/30 42/25

* cited by examiner

*Primary Examiner* — Samir Abdosh
(74) *Attorney, Agent, or Firm* — Gerhard W. Thielman, Esq.

(57) ABSTRACT

A traverse stop clamp is provided for restricting sweep of a machine gun mounted on a tripod. The stop clamp is installable on a traverse bar connecting to rear legs of the tripod, the traverse bar having an inverse U-shape cross-section that form edges at ends of the U-shape. The stop clamp includes an open ring member, a shift member, a handle, a spring pin and a locking nut. The open ring member has a C-shaped ring with an interrupted circumferential outer periphery and an inner periphery with channels for receiving the edges of the traverse bar. The outer periphery has first and second ring ends separated by an adjustable gap. The open ring member further includes first and second tabs disposed to extend radially outward from the first and second ends. These first and second tabs respectively have first and second through-holes. The shift member has a tang and a shaft at respectively first and second shifter ends. The receiver has a third through-hole, and the shaft has a threaded terminus. The tang and shaft pass respectively through the first and second through-holes. The handle has a lever and a clevis head with coaxial fourth through-holes. The head has a cam separating a lock clevis face and a release clevis face. The lock clevis face engages the tang in response to the lever being adjacent the outer periphery. The release clevis face engages the tang in response to pulling the lever away from the outer periphery. The handle pivots at the fourth-through-holes to widen the gap between the tabs. The spring pin passes through the fourth and third through-holes to connect the tang and the clevis head pivotably together. The threaded lock nut attaches to the threaded terminus to engage the second tab.

2 Claims, 10 Drawing Sheets

MECHANISM TO ADJUST AND RESTRAIN GUN TRAVERSE ON A TRIPOD MOUNT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to devices that limit traverse motion on machine gun tripods. In particular, the invention relates to devices designed as a physical stop to limit pivot sweep angle of fire from a machine gun mounted to a tripod.

The US Army (USA) and US Marine Corps (USMC) have used the M122 machine gun tripod since about 1935, which provides a more stable and versatile platform for accurate and controlled angular sweep during successive firings than available by the bipod mounted to a standard M240 machine gun. To enable soldiers and marines to flank a position forward of the M240 gun, the gunner restricts the sweep with a rear leg of the M122 tripod for the first side, and a hose clamp (or duct tape) for the second side. Such conventional and impromptu techniques do not provide definitive stopping positions and can be cumbersome and time-consuming to install.

FIGS. 1A and 1B provide illustrations for the conventional M122 tripod and related equipment for comparative purposes. FIG. 1A shows an isometric view 100 of the M122 tripod main components, including the tripod stand 110. A mounting head 120 includes a mount orifice on its crown into which a pintle front yoke 125 can be inserted. A front leg 130 with front foot pad 135 attaches to the head 120. The tripod 110 also includes a pair of rear legs extending from the head 120: rear starboard leg 140 with rear foot pad 145, and rear port leg 150 with a similar rear foot pad. The starboard and port legs 140 and 150 are joined together by a traverse bar 155 onto which a traverse-and-elevation (T&E) mechanism 160 can be attached to adjust the firing direction of the gun M240. The T&E mount 160 includes a rear yoke 165. The traverse bar 155 can be straight (for reduced manufacturing complexity) or form a curve arc to maintain gun azimuth position. The M122 tripod weighs about 16 lb (7.3 kg).

FIG. 1B shows an isometric view 170 of the M122 tripod 110 together with a M240 machine gun 180 with integral folded bipod 185. The gun 180 includes a fore ring 190 that attaches to a first removable pin on the front yoke 125, and an aft ring 195 that attaches to a second removable pin on the rear yoke 165 of the T&E mechanism 160 (shown correctly positioned on the traverse bar 155 in view 170).

SUMMARY

Conventional traverse stop devices for machine gun tripods yield disadvantages addressed by various exemplary embodiments of the present invention. In particular, exemplary embodiments provide a traverse stop clamp for restricting sweep of a machine gun mounted on a tripod. The stop clamp is installable on a traverse bar installed on rear legs of the tripod, the traverse bar having an inverse U-shape cross-section that form edges at ends of the U-shape. The stop clamp includes an open ring member, a shift member, a handle, a spring pin and a locking nut.

In exemplary embodiments, the open ring member has a C-shaped ring with an interrupted circumferential outer periphery and an inner periphery with channels for receiving the edges of the traverse bar. The outer periphery has first and second ring ends separated by an adjustable gap. The open ring member further includes first and second tabs disposed to extend radially outward from the first and second ends. These first and second tabs respectively have first and second through-holes. The shift member has a tang and a shaft at respectively first and second shifter ends. The receiver has a third through-hole, and the shaft has a threaded terminus. The tang and shaft pass respectively through the first and second through-holes. The handle has a lever and a clevis head with coaxial fourth through-holes.

The head has a cam separating a lock clevis face and a release clevis face. The lock clevis face engages the tang in response to the lever being adjacent the outer periphery. The release clevis face engages the tang in response to pulling the lever away from the outer periphery. The handle pivots at the fourth-through-holes to widen the gap between the tabs. The spring pin passes through the fourth and third through-holes to connect the tang and the clevis head pivotably together. The threaded lock nut attaches to the threaded terminus to engage the second tab.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced.

These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments are provided in response to USMC requirements. The adjustable traverse limiting clamp constitutes part of the tripod system and has been designed for quick, easy, and secure position adjustments of sweep angle. The clamp can slide freely along the traverse bar and be locked into position by a cam lever. The clamp functions as a physical stop to the traverse of a tripod-mounted gun so as to be quickly reset to another position without the need of tools.

Figure 1A:
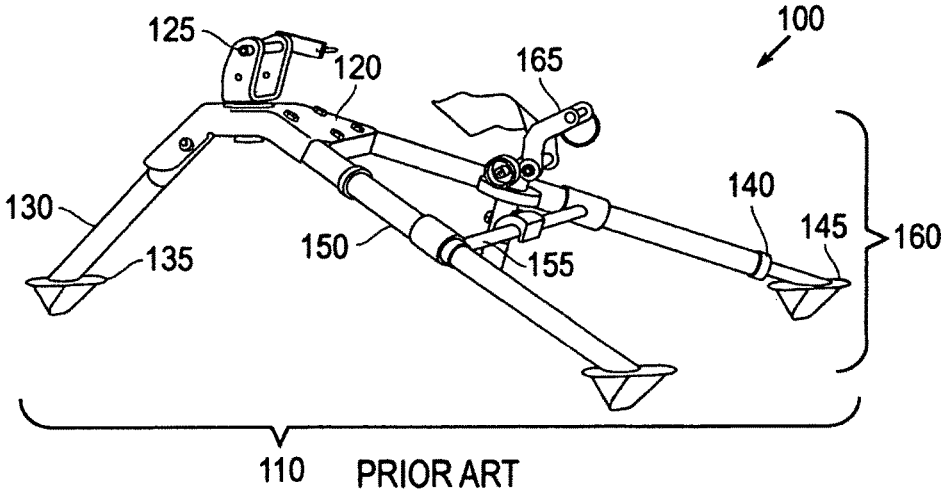
FIG. 1A is an isometric view of a conventional M122 tripod.
Figure 1B:
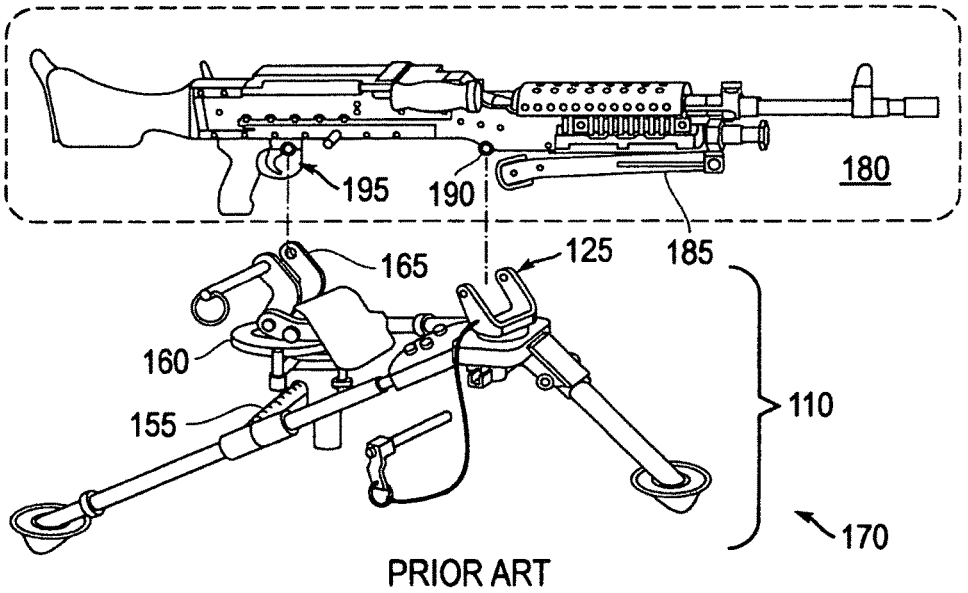
FIG. 1B is an isometric view of the M122 tripod with a M240 gun.
Figure 2A:
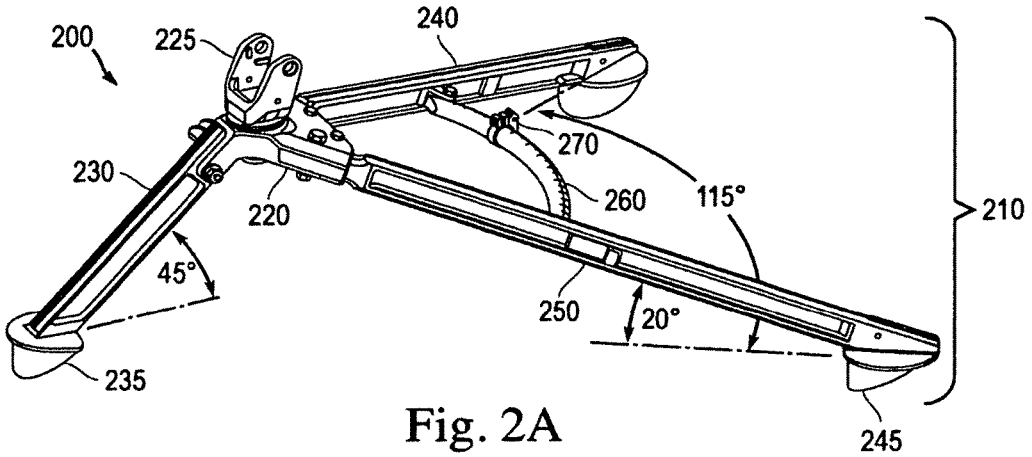
FIG. 2A is an isometric view of a tripod with exemplary traverse bar.

FIG. 2A shows an isometric assembly view 200 of an exemplary tripod 210. A mounting head 220 includes a mount orifice on its crown into which a pintle front clevis 225 can be inserted. A front leg 230 with front foot pad 235 attaches to the head 220. The tripod 210 also includes a pair of rear legs extending from the head 220: rear starboard leg 240 with rear foot pad 245, and rear port leg 250 with a similar rear foot pad. The starboard and port legs 240 and 250 are joined together by a traverse bar 260 featuring an exemplary traverse stop clamp 270 attached thereon. The tripod 210 is formed substantially from forged aluminum parts and the legs 230, 240 and 250 form I-beam structures rather than tubes to reduce weight. The fore leg 230 has an approximate length of nine inches and is elevated from ground level by 45°, and the rear legs 240 and 250 have approximate lengths of seventeen inches and are elevated from the ground by 20°. The rear legs 240 and 250 are angularly separated by 115°. These dimensions are exemplary for the configuration designed, and are not limiting.

Figure 2B:
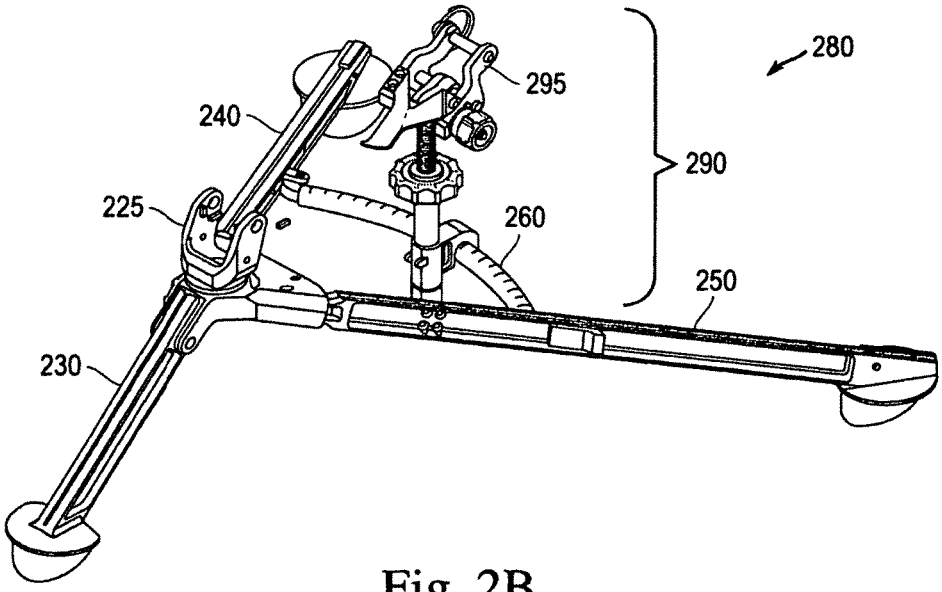
FIG. 2B is an isometric view of the tripod with a T&E adjuster.

FIG. 2B shows an isometric view 280 of the exemplary tripod 210 together with an exemplary traverse-and-elevation (T&E) mechanism 290 attaches to the traverse bar 260. In the example provided, the traverse bar 260 is curved to form an arc. The T&E mechanism 290 includes a yoke assembly 295 onto which the aft ring 195 attaches, while the fore ring 190 attaches to the pintle clevis 225 by a retractable pin (analogous to that shown in view 170).

Figure 3:
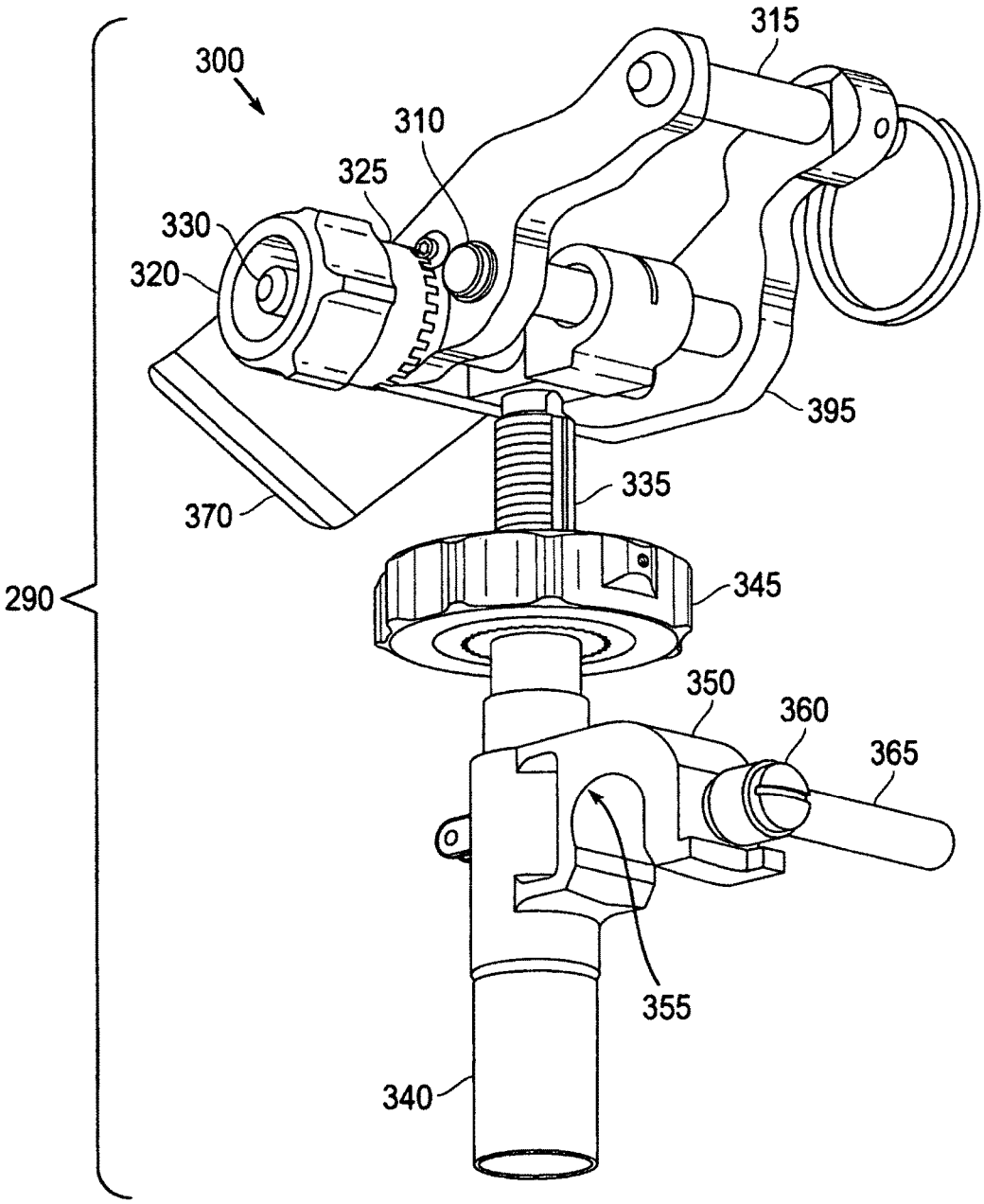
FIG. 3 is an isometric view of the T&E adjuster.

FIG. 3 shows an isometric view 300 of a T&E adjuster 290. A pin 310 connects to the yoke assembly 295 that includes retractable pin 315 and a traversing knob 320. The pin 310 guides an upper elevating screw 330 to inhibit rotation as a traversing screw 335 winds back and forth. The yoke assembly 295 attaches to the upper elevating screw 330 by the pin 310 and by the traversing screw 335. These two screws 330 and 335 ensure that the yoke assembly 295 can only translate back and forth across the upper elevating screw 330. The retractable pin 315 connects the aft ring 195 (view 170) of the M240 gun. Azimuth of the yoke assembly 295 can be manually adjusted by the control knob 320 with ring graduations 325.

The T&E adjuster 290 also includes a graduated shaft 335, a base 340, an azimuth adjustment wheel 345 (between the shaft 335 and the base 340), a bracket 350 with a mounting channel 355 that rests on the traverse bar 260. A screw 360 on the bracket 350 enables tightening of the channel 255 on the bar 260 via a handle 365. The shaft 335 extends below the elevating wheel 345 and is threaded to enable elevation of the yoke assembly 295 for adjustment up and down. The shaft 335 is threaded externally and internally so that the upper elevating screw 330 can insert therein and threads into the base 340 when the yoke assembly 295 is being descended.

Figures 4A, 4B:
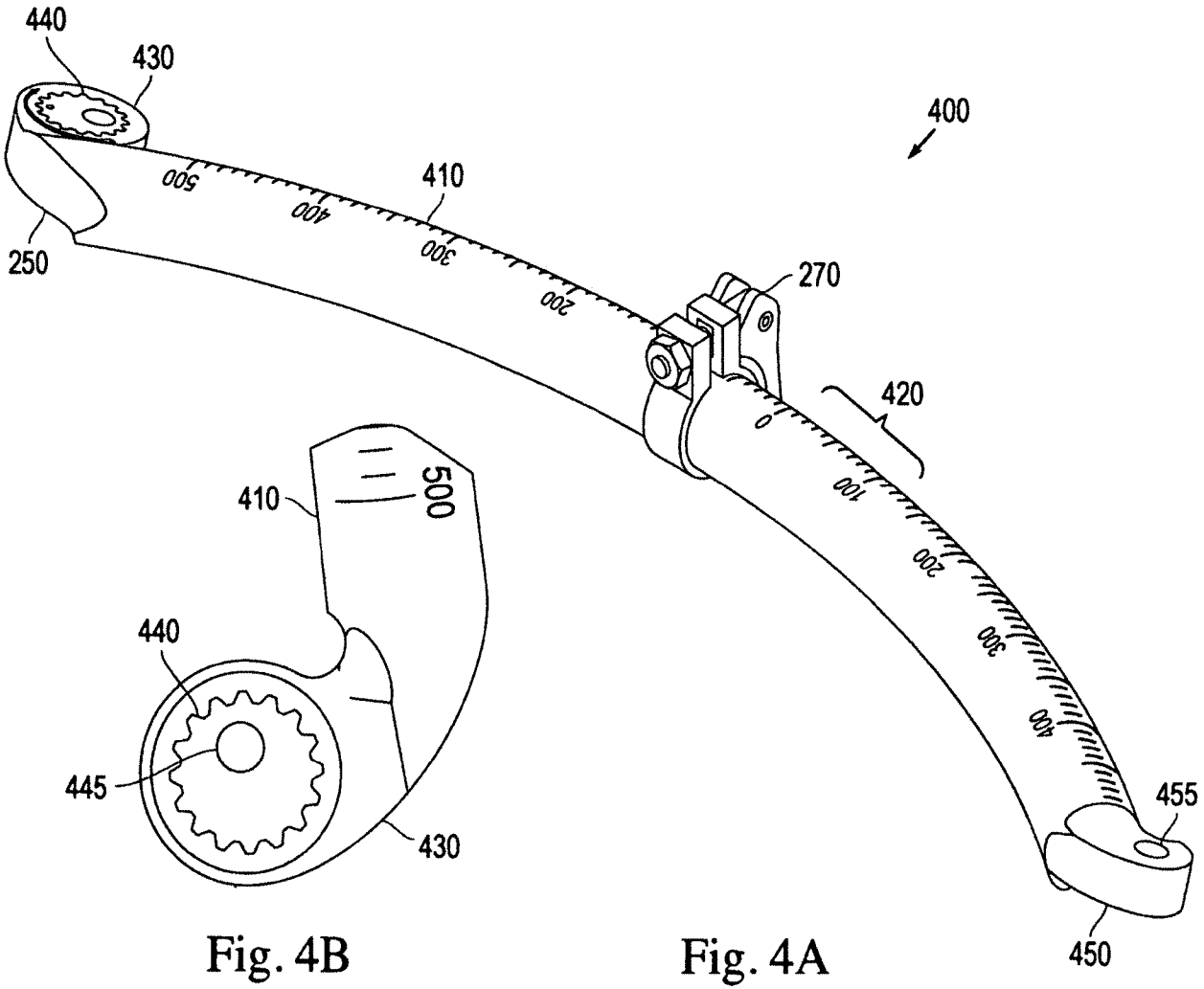
FIG. 4A is an isometric view of the traverse bar with an associated traverse clamp.
FIG. 4B is a detail plan view of an adjustment connector for the traverse bar.

FIG. 4A shows a first isometric view 400 of traverse bar 260 with the stop clamp 270. The traverse bar 260 includes an elongated member 410 with graduations 420 marked thereon. The traverse bar 260 terminates on the starboard leg 240 at a first end 430 with an adjustable sprocket 440, and on the port leg 250 at a second end 450. The first end 430 can disconnect and slide forward along the starboard leg 240 to fold the tripod 210. FIG. 4B shows a detail plan view of the first end 430 with the adjustable sprocket 440 and an offset through-hole 445. The first end includes a cavity having annularly arranged teeth, sixteen being shown in this configuration, although this characteristic is not limiting. The second end 450 has a through-hole 455 in the center that pivots on the port leg 250. Both sides of the traverse bar 260 pivot and slide within the legs 240 and 250. Having the connection points slide and pivot permits a more compact shape when closed as well as shorter leg lengths than for a single pivot design. The traverse bar 260 has an exemplary straightline length from the center of the first end 430 to the center of the sprocket 440 of 12.297 inches.

Figure 4C:
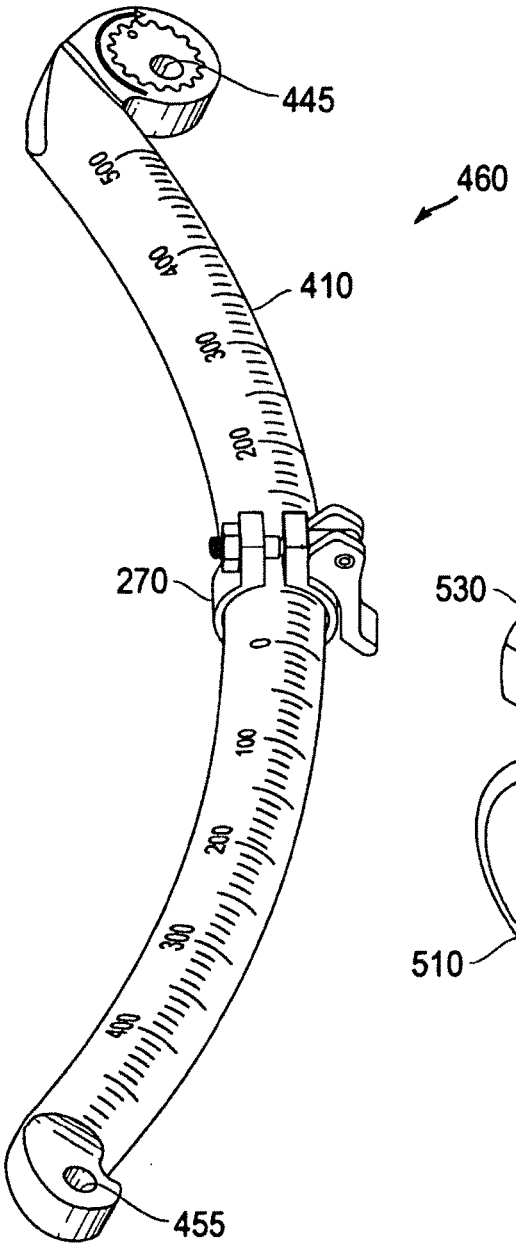
FIGS. 4C and 4D are isometric views of the traverse bar.
Figure 4D:
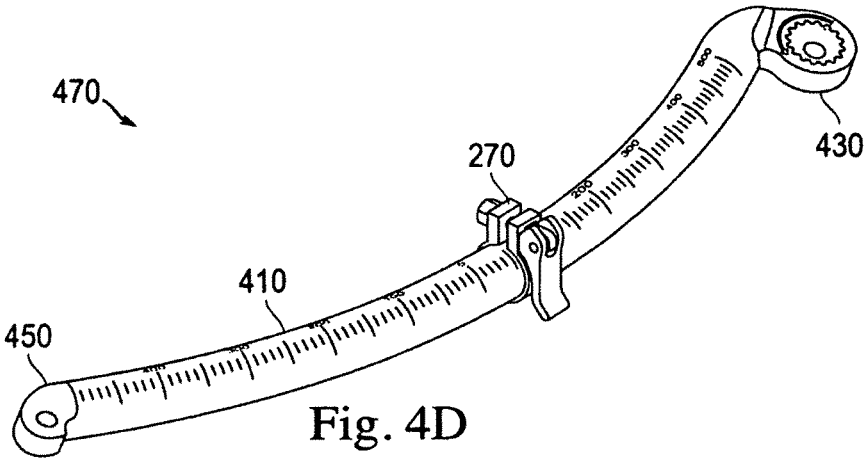
Figure 4E:
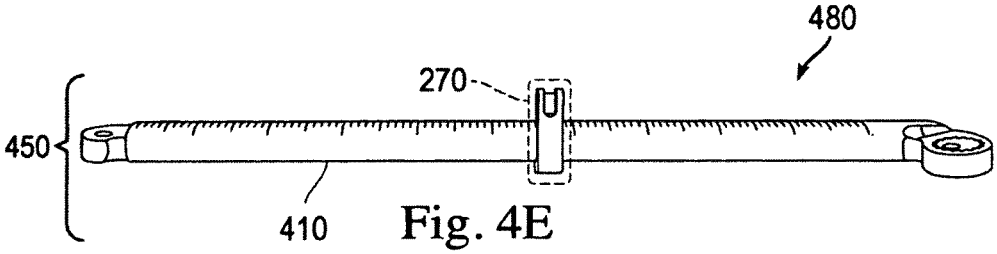
FIG. 4E is an elevation view of the traverse bar.

The sprocket 440 can be produced separately from the traverse bar 270, such as by extrusion and slicing perpendicular to its symmetry axis. The offset hole 445 enables its position to be altered by pushing the sprocket 440 out of the first end 430, turning the sprocket 440, and then reinserting that back into the first end 430. By angularly repositioning the hole 445, the tension between the legs 240 and 250 can be increased in response to fatigue wear loosening the original geometry, thereby necessitating adjustment. FIGS. 4C and 4D respectively show second and third isometric views 460 and 470 of the traverse bar 260 with the stop clamp 270. FIG. 4E shows an elevation view 480 of the traverse bar 260 with the clamp 270 to provide the traverse limit assembly 490.

Figure 5A:
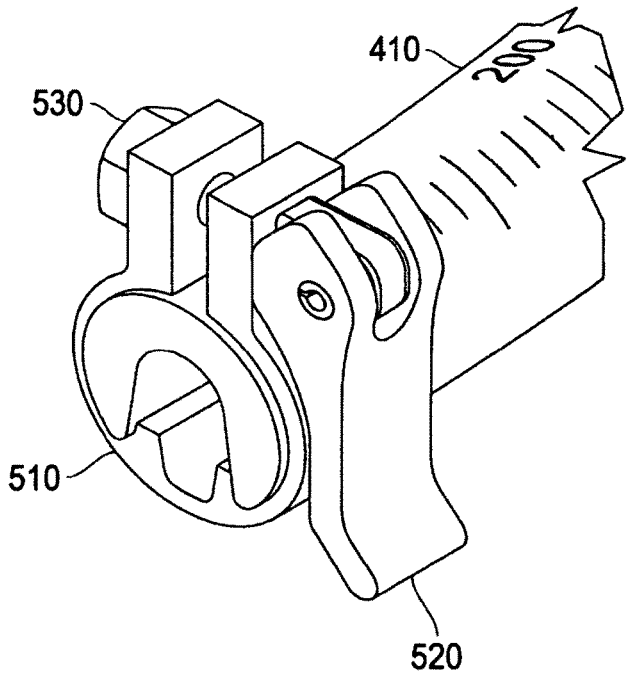
FIG. 5A is an isometric detail view of an exemplary clamp.
Figure 5B:
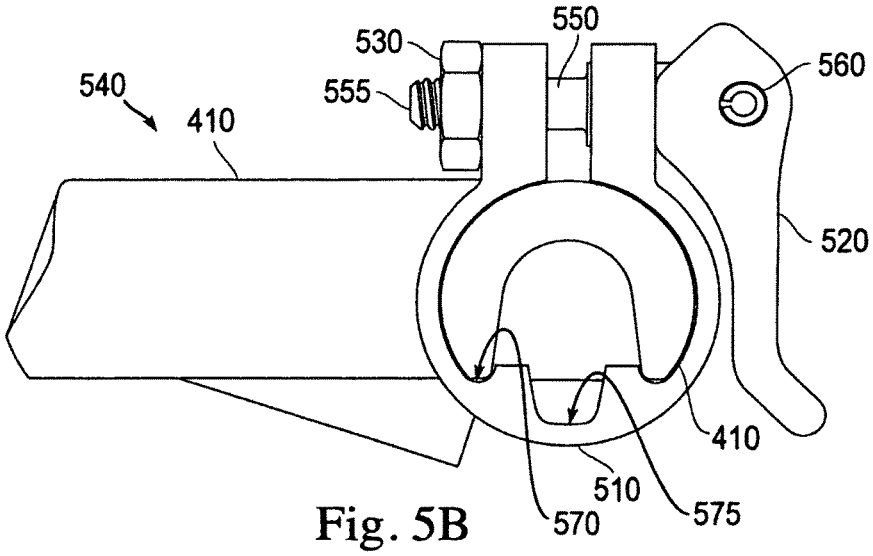
FIG. 5B is an elevation detail view of the exemplary clamp.

FIG. 5A shows an isometric detail view 500 of the stop clamp 270 with the elongated member 410 in cross-section. The stop clamp 270 includes an open ring member 510 and a handle 520 that tightens a tension member held by a threaded self-locking nut 530. FIG. 5B shows an elevation detail view 540 of the stop clamp 270 with the traverse bar 410 in cross-section, which is shown as an inverted U-shape. The tension member includes a shaft 550 with a threaded portion 555 onto which the nut 530 screws onto. The handle 520 pivots on a spring pin 560.

The inner profile of the ring member 510 includes flanking channels 570 for receiving and restricting the traverse bar 410 and an optional central channel 575 as a hinge line for the clamp. However, sufficient flexibility existed in the ring member 510 that this was deemed somewhat superfluous, but not adverse to operation. The flanking channels 570 inhibit rotation of the stop clamp 270 while sliding along the elongated member 410. By contrast, the DISA mount for German MG3 machine gun included traverse stops for a traverse bar having a key spline to inhibit rotation of its associated clamp, which was a bivalve composition, the distal end secured to the spline and the proximal end being adjustable by lock washers and shims, and lockable by a pivoting handle.

Figure 6A:
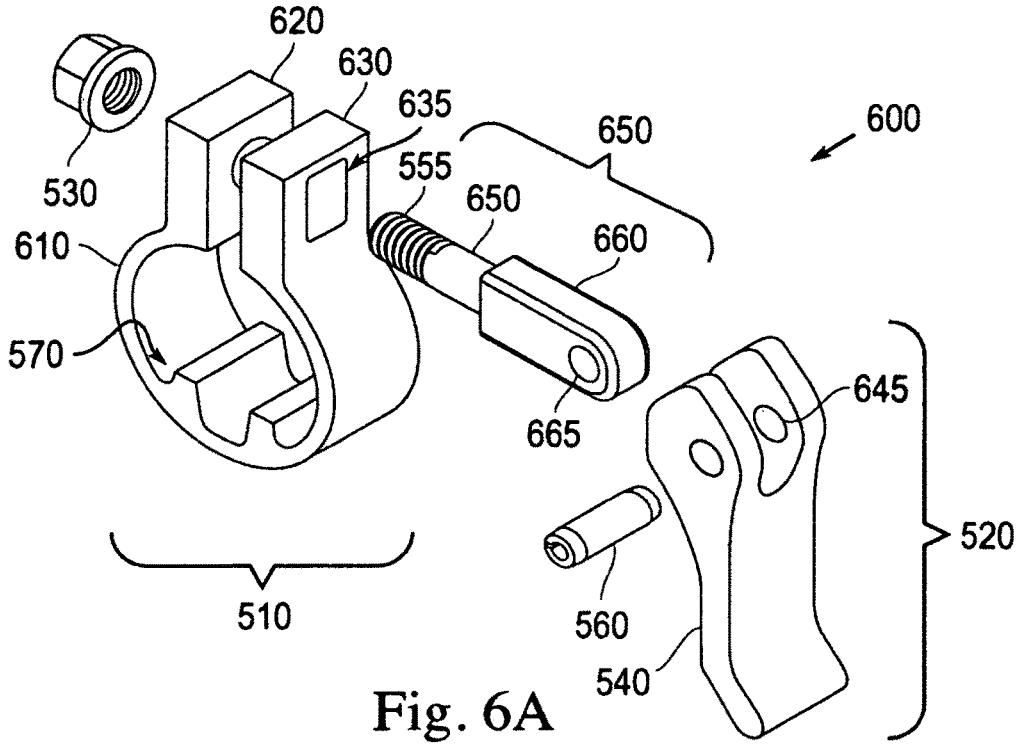
FIGS. 6A and 6B are isometric exploded views of the clamp.

FIG. 6A shows a first perspective exploded view 600 of the stop clamp 270. The open ring member 510 includes an interrupted C-ring 610, a distal tab 620 with a circular through-hole 625 and a proximal tab 630 with a rounded rectangular through-hole 635. The C-ring 610 has an interrupted circular outer periphery and an inner geometry that includes channels 570 for receiving edges of the elongated member 410. The inner geometry can optionally include central cavity 575. The handle 520 includes a lever 640 and co-axial clevis holes 645.

A cam screw 650 includes a tang 660 and the shaft 550 with threaded portion 555. The shaft 550 passes through the circular through-hole 625, and the tang 660 passes through the rectangular through-hole 635. The tang 660 includes a circular through-hole 665. This rectangular hole 635 ensures that the handle 520 does not spin in operation around the axis of the shaft 550, but rotates only along the parallel planes of the open ring member 510. The spring pin 560 passes through the clevis holes 645 and the circular hole 665 to pivotably connect the handle 520 and the tang 660. The spring pin 560 constitutes a standard off-the-shelf component that holds the clevis block 680 to the cam screw 650 and provides a pivot point for the handle 520.

Figure 6B:
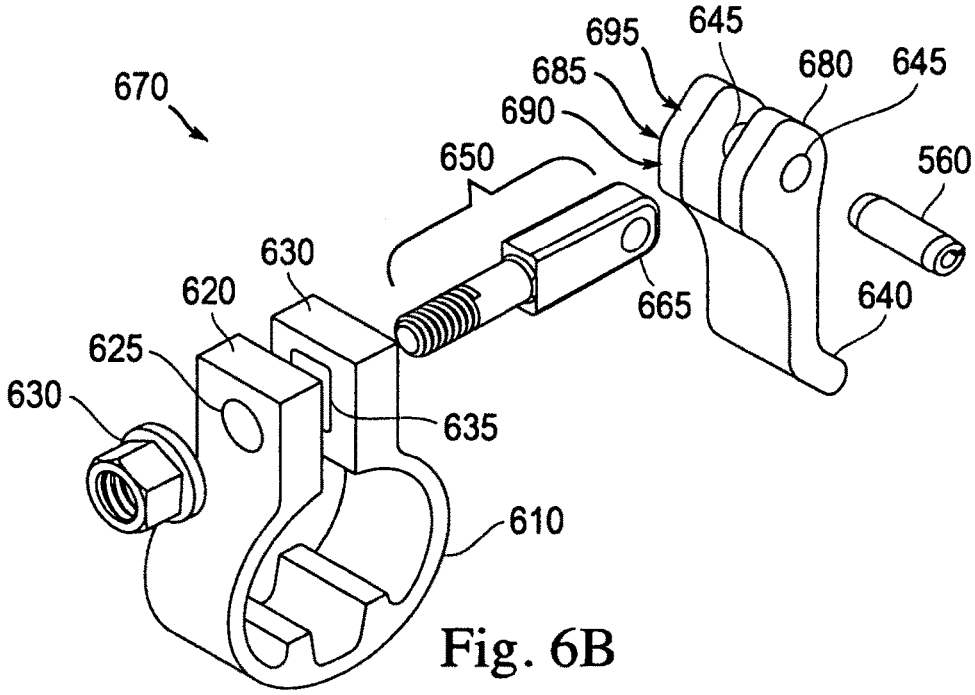

FIG. 6B shows a second perspective exploded view 670 of the stop clamp 270. A clevis block 680 contains the clevis holes 645 and connects rigidly to the lever 640. The block 680 includes a cam 685 that enables the handle 520 to lock and unlock the stop clamp 270. The cam 685 divides parallel lock surfaces 690 from parallel release surfaces 695 on the block 680. The nut 530 holds the cam 685 and the cam screw 650 onto the open ring member 510. It can be tightened or loosened on the cam screw to increase or decrease the clamping force of the traverse stop. The self-locking nature of the nut will prevent it from unscrewing and falling off the assembly during operation.

Figures 7A, 7B:
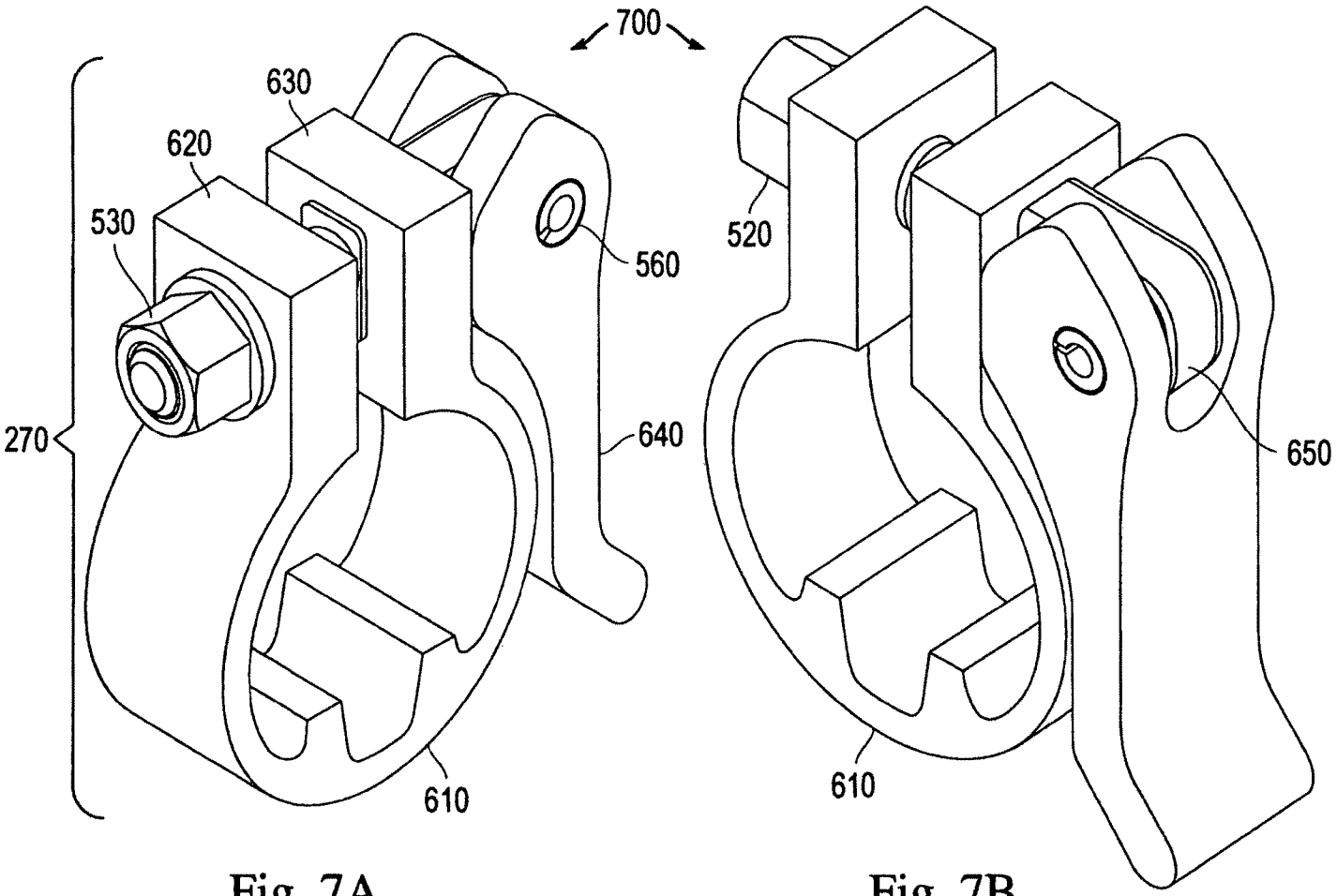
FIGS. 7A and 7B are a isometric views of the clamp.
Figure 7C:
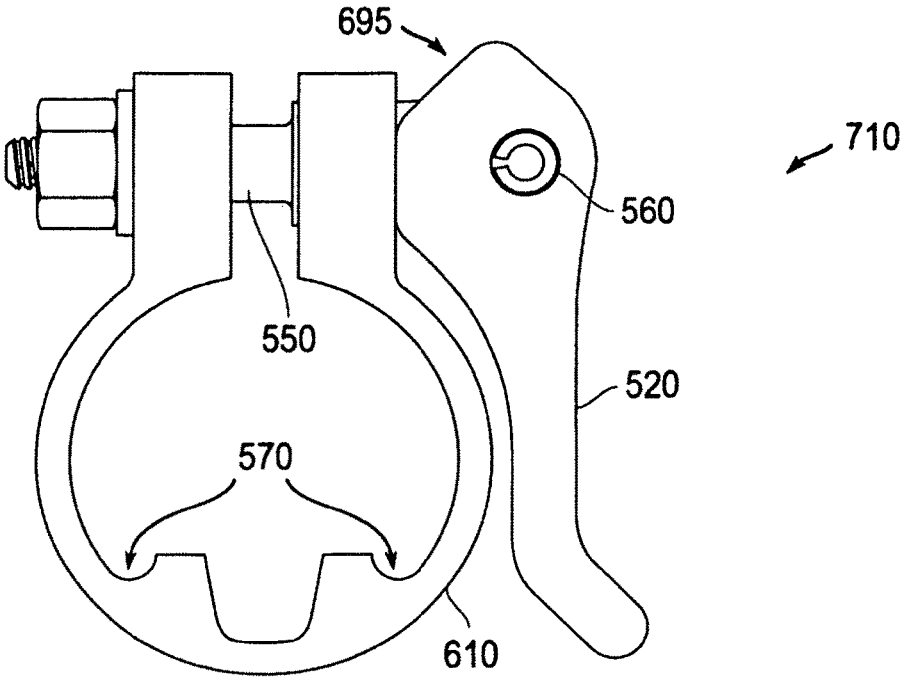
FIGS. 7C and 7D are elevation views of the clamp.
Figure 7D:
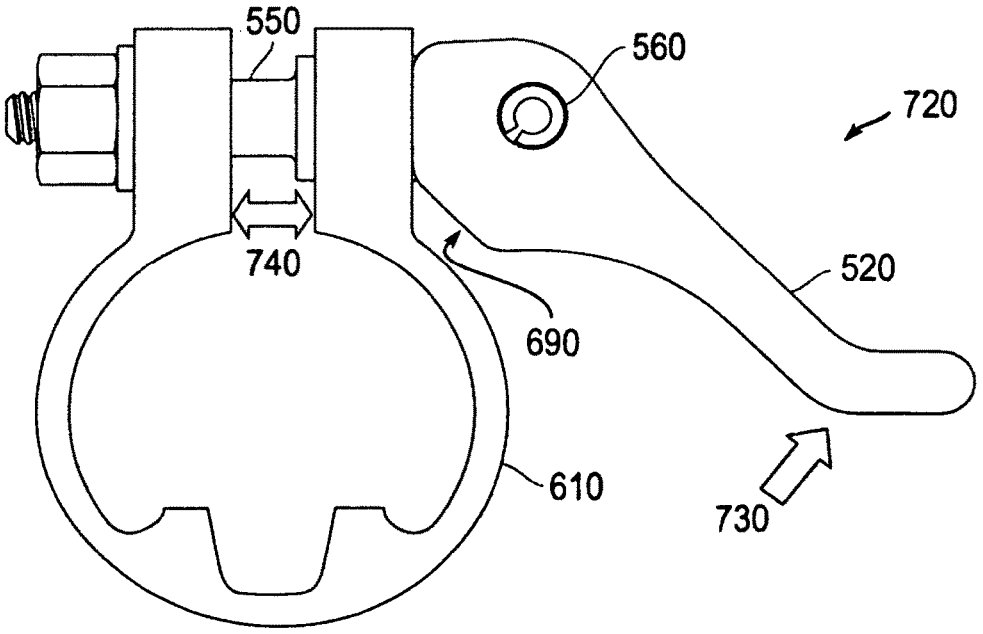

FIGS. 7A and 7B show perspective assembly views 700 of the stop clamp 270 in the lock position. FIGS. 7C and 7D show respective elevation assembly views 710 and 720 of stop clamp 270. The lock assembly view 710 features the C-ring 610 of the open ring member 510 under compression load while the lock surfaces 690 engage the tang 660. The release assembly view 720 shows a pull force shown by arrow 730 against the lever 640 rotating the handle 520 about the spring pin 560. This causes a gap to widen between the tabs 620 and 630, shown by arrows 740, and thereby opens the C-ring 610, enabling the stop clamp 270 to slide along the elongated member 410. Lifting the cam lever 520 does not cause the tabs 620 and 630 to spread. The C-ring 610 is under tension and the separated tabs 620 and 630 are in their relaxed state.

Figure 8A:
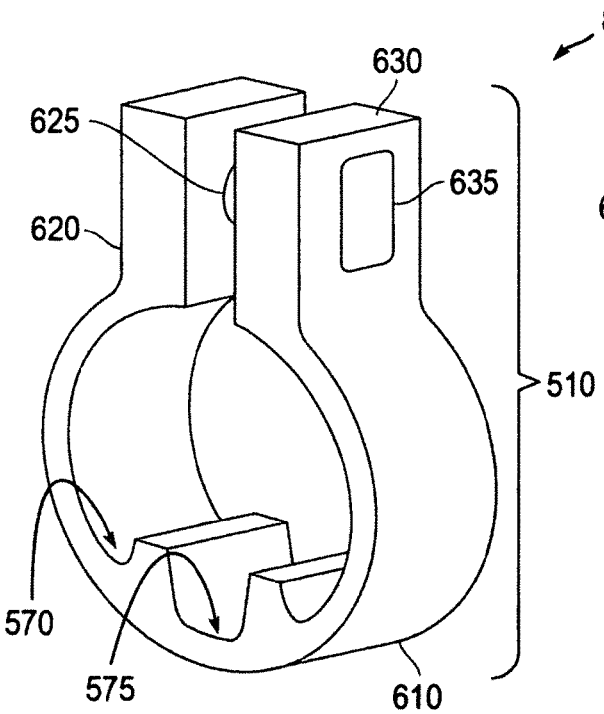
FIGS. 8A, 8B and 8C are isometric views of clamp components.
Figure 8B:
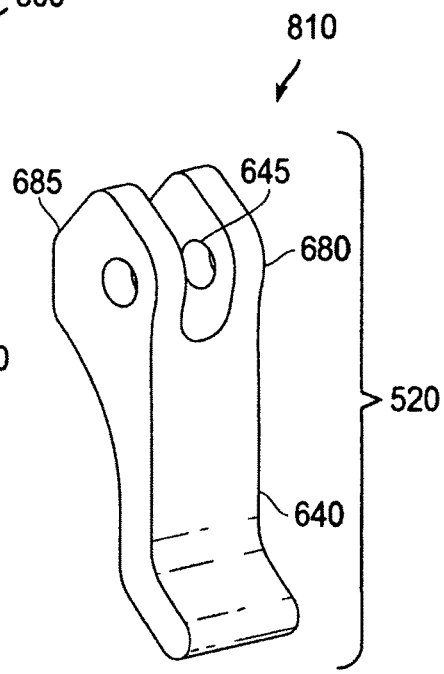
Figure 8C:
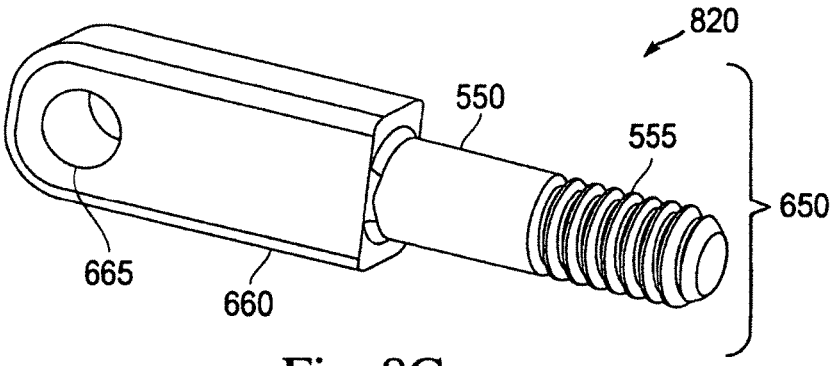

FIGS. 8A, 8B and 8C feature select components of the clamp 270. FIG. 8A shows a perspective view 800 of the open ring member 510 as an integral item including the C-ring 610 and parallel tabs 620 and 630. FIG. 8B shows a perspective view 810 of the handle 520 with the lever 640 and the clevis block 680. FIG. 8C shows a perspective view 820 of the cam screw 650 with the tang 660 and the shaft 550 with threaded portion 555. For exemplary size perspective, the C-ring 610 has respective outer and inner diameters of 00.850 inch and 00.750 inch.

The exemplary traverse stop clamp 270 enjoys advantages over conventional hose clamps, being easily adjustable with only one hand, requiring no special tools, and remaining connected to the traverse bar 260. The stop clamp 270, when engaged with the lever 640 pushed adjacent the C-ring 610, provides sufficient hoop compression to hold the stop clamp 270 fixed on the traverse bar 260. Pulling the lever 640 loosens the C-ring 610 and enables the stop clamp 270 to slide along the elongated member 410 for rapid adjustment of firing sweep limits in the field.

In summary, the cam screw 650 operates as a tensioner when the stop clamp 270 is engaged with the elongated member 410. The tang 660 prevents the handle 520 from rotating within the stop clamp 270. Optionally, the stop clamp 270 by its configuration maintains upright orientation on the traverse bar 260. This rotation inhibition is accomplished by aligned channels that conform to a hollowing chamber of the elongated member 410, the latter design feature having the advantage of reduced weight.

The exemplary adjustment sprocket 450 and offset through-hole 450 enable tension compensation of the traverse bar 260 when connecting the legs 240 and 250 together. By altering the angular position of the hole 450 in the first end 430, the length of the traverse bar 260 can be extended slightly, to compensate for misalignment and component wear from field use. The hole 450 can be repositioned by removing the sprocket 440 from the toothed cavity in the first end 430, rotating the sprocket 440 in relation to its previous position, and reinserting the sprocket 440 within the toothed cavity, both cavity and sprocket 440 having complementary patterns that provide a snug non-interference fit.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A traverse stop clamp for restricting sweep of a machine gun mounted on a tripod, said stop clamp being installable on a traverse bar that connect to rear legs of said tripod, said traverse bar having an inverse U-shape cross-section that form edges at ends of said U-shape, said stop clamp comprising:

an open ring member having a C-shaped ring with an interrupted circumferential outer periphery and an inner periphery with channels for receiving the edges of the traverse bar, said outer periphery having first and second ring ends separated by an adjustable gap, and first and second tabs disposed to extend radially outward from said first and second ends, said first and second tabs respectively having first and second through-holes;

a shift member having a tang at a first shifter end and a shaft at a second shifter end, said receiver having a third through-hole, said shaft having a threaded terminus, said tang and shaft passing respectively through said first and second through-holes;

a handle having a lever and a clevis head with coaxial fourth through-holes, said head having a cam separating a lock clevis face and a release clevis face, said lock clevis face engaging said tang in response to said lever being adjacent said outer periphery, said release clevis face engaging said tang in response to pulling said lever away from said outer periphery, said handle pivoting at said fourth-through-holes to widen said gap between said tabs;

a spring pin passing through said fourth and third through-holes to connect said tang and said clevis head pivotably together; and a threaded lock nut attaching to said threaded terminus to engage said second tab.

2. The stop clamp according to claim 1, wherein said first through-hole has a rounded rectangular cross-section.

* * * * *